United States Patent [19]

Stamm

[11] Patent Number: 4,691,498

[45] Date of Patent: Sep. 8, 1987

[54] PROCESS AND MACHINE FOR HOOPING A PACKAGE WITH A HOOPING BAND

[75] Inventor: Nikolaus Stamm, Kilchberg, Switzerland

[73] Assignee: A. Konrad Feinmechanik AG., Mehrenschwand, Switzerland

[21] Appl. No.: 834,401

[22] Filed: Mar. 3, 1986

[30] Foreign Application Priority Data

Mar. 15, 1985 [CH] Switzerland ..... 1180/85

[51] Int. Cl.[4] ..... B65B 13/22

[52] U.S. Cl. ..... 53/399; 53/589; 100/32

[58] Field of Search ..... 53/582, 589, 399; 100/29, 32; 156/494, 361

[56] References Cited

U.S. PATENT DOCUMENTS

| | | | |
|---|---|---|---|
| 3,470,814 | 10/1969 | Tschappu | 53/589 X |
| 4,218,969 | 8/1980 | Kasuga | 100/32 |
| 4,271,655 | 6/1981 | Nagayoshi | 53/589 X |
| 4,559,767 | 12/1985 | Takami | 53/589 |
| 4,569,186 | 2/1986 | Mori | 53/589 |

*Primary Examiner*—John Sipos

*Attorney, Agent, or Firm*—Bachman & LaPointe

[57] ABSTRACT

The band movement drive of a machine for the automatic hooping of a package with a hooping band has a main band drive and a secondary band drive. During band advance, the hooping band is guided by the main band drive at a first, higher speed in a band channel for enveloping the package up to its entry in a joining station, followed by a switching over to band retraction, which takes place at the same higher speed. The secondary band drive is driven at a higher speed than the main band drive, so that a band reserve is formed beween the two band drives. When the hooping band is loosely applied to the package, switching over takes place to a second, lower speed, at which the band reserve is retracted. The hooping band is then tensioned with the tension set on the main band drive and then in the joining station the band and band end are joined together and the band is separated from the band supply. During the time created during the retraction of the band reserve, it is possible to switch over clutch in the band movement drive for changing to the second, lower speed without damaging the hooping band or package through overtensioning.

8 Claims, 3 Drawing Figures

PROCESS AND MACHINE FOR HOOPING A PACKAGE WITH A HOOPING BAND

BACKGROUND OF THE INVENTION

The present invention relates to a process and apparatus for hooping a package with a hooping band wherein the band is removed from a band supply by means of a drive and is then loosely wrapped around the package until the band end is received and held in a joining station, after which the band is retracted and pretensioned, the band end and band in the pretensioned state being joined in the joining station.

For the purpose of hooping a package with one or more hooping bands numerous processes and machines are known. The function thereof is to tension the hooping band placed around the package, to join the band end to the band and to separate the band from the band supply. In the case of machines for hooping larger packages it is known to allow the hooping process to take place automatically and without any manual intervention (U.S. patent application Ser. No. 710,034). In such a process, the package is placed on a base provided with a yoke, into which is incorporated a band movement means, with which the hooping band is moved through the yoke and the package is enveloped in a large loop until the band end is introduced and held in a joining station. The band movement means is then switched over to band retraction, so that the hooping band is placed around the package, tensioned and joined to the band end, while also being separated from the band supply.

In order to achieve a high hooping capacity with such a band hooping machine, working takes place at maximum band speeds. The high speed advance in the yoke-like band channel does not constitute a particular problem and can be relatively easily realized. However, if band retraction and the placing of the hooping band around the package are to take place rapidly and with tension, while protecting the package, but still adequately tensioning same, the band retraction can only take place at the maximum speed not leading to tension peaks on switching off the band drive non-positively guiding the band, because such peaks would either lead to the band tearing or to the package being damaged. This means that the band retraction must take place at a lower speed, which has an unfavorable effect on the hooping capacity.

SUMMARY OF THE INVENTION

The object of the present invention is to so develop a process of the aforementioned type wherein band retraction takes place at high speed and despite this tension peaks in the band are avoided on switching off the band movement drive.

According to the invention the foregoing object is achieved in that the retraction of the hooping band takes place in two parts, the first part up to the loose engagement of the hooping band on the package taking place at a first, higher speed, while the further part up to the tensioning of the band to the desired tension taking place at a second, lower speed, there being a band transport interruption for the transition from the first to the second speeds.

The invention also covers a machine for performing the process according to the invention enabling the process to be performed in an optimum manner. According to the invention the foregoing object is achieved in that between the main band drive and the joining station there is provided a secondary band drive which, during band retraction and up to the loose engagement of the hooping band on the package, has a higher band speed than the band speed of the main band drive.

BRIEF DESCRIPTION OF THE DRAWINGS

The invention is described in greater detail hereinafter relative to non-limitative embodiments and the attached drawings, wherein show.

DETAILED DESCRIPTION

Figure 1:
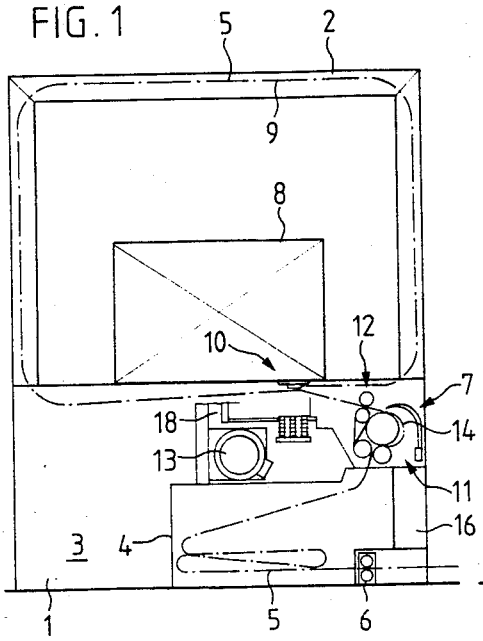
FIG. 1 is a side view, partly in section, of a machine for the automatic hooping of a package with a hooping band, the latter being passed through a band channel and the band end has reached a joining station.
Figure 2:
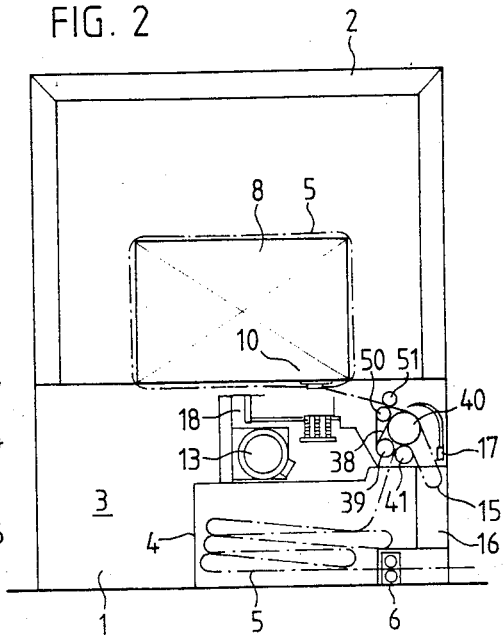
FIG. 2 is a further side view of the machine according to FIG. 1, in which the band guided in the band channel has been slightly drawn back around the package and simultaneously a band reserve has formed in the band movement drive.

The machine shown in FIGS. 1 and 2 represents two phases of the automatic hooping of a package 8 with a hooping band. The machine has a base with a yoke-like band channel 2 placed thereon. A container 4 for receiving a supply of hooping band is located in its inner area 3. The hooping band 5 can be introduced into container 4 by a band feed 6.

The hooping band 5 can be moved backwards and forwards by a reversible band movement drive 7. During band advance, the band is guided in guides (not shown) of the band channel 2, a loop 9 being formed around the package 8, the band end being placed and secured in a joining station 10 positioned below the package 8. The band movement drive 7 has a main band drive 11 constructed as a non-positive roller pair and a secondary band drive 12 constructed as a roller pair. The main band drive 11 and secondary band drive 12 are jointly driven by a motor, such as an electric motor 13, as is represented in detail in FIG. 3.

FIG. 2 shows the band hooping machine upon the hooping of package 8. As soon as the end of the hooping band 5 is held in joining station 10, the band movement drive 7 is reversed to band retraction. The hooping band is now led back into container 4, the band being freed from the band channel 2 and is lightly placed around the package 8, as shown in FIG. 2. It is now desirable to place the hooping band 5 around package 8 and tension same in such a way that band 5 is not torn and package 8 is not damaged through excessive band tension; however, the hooping process must still be performed with the maximum speed. To this end, the band advance in band channel 2 is performed at high speed. When the band end enters the joining station 10, the main band drive is disengaged in a manner explained hereinbelow. As a function of the size of the moved masses (inertia) of the main band drive 11, the drive 11 still advances somewhat after disengagement and can form a loose band loop 14. As the moved masses (inertia) are relatively small, the band loop 14 is also relatively small.

After disengaging the main band drive 11, the drive 11 is reversed for band retraction. Retraction is performed at high speed. Together with the main band drive 11, the secondary band drive 12 is also driven and its pair of rollers is in fact driven at a higher speed than the pair of rollers of the main band drive 11. As a result, less band length is returned to container 4 than is supplied by the secondary band drive 12. As a result a band reserve 15 is formed in the form of a loop, whose size results from the difference between the two band speeds of drives 11 and 12 and the difference between the band length in the band channel and the length for hooping the package 8. A collecting magazine 16 in the inner area 3 of base 1 is provided for receiving the band reserve. If for any reason the band reserve 15 filled the collecting magazine, a level indicator 17 is provided, which supplies a signal for switching off the machine.

The band reserve 15 is formed until the hooping band 5 has been placed lightly around package 8. This is followed by the switching of the main band drive 11 to a second, lower band retraction speed, at which initially band reserve 15 is used up, so that band reserve 15 is moved back into container 4. As soon as band reserve 15 has been used up, the hooping band 5 placed around package 8 is retracted and tensioned to the extent corresponding to the setting of an electromagnetic clutch, to be explained hereinbelow, arranged in the drive branch for the second lower speed.

For as long as the main band drive 11 draws back the band reserve 15, there is an interruption in the band transport of the band loop placed around package 8. On switching from the first, higher retraction speed to the second, lower speed, no masses are directly connected to the hooping band, this only taking place via band reserve 15 (the secondary band drive 12 being automatically disengaged), which is linked with the switching over of generally two electromagnetic clutches, no additional forces are exerted on the hooping band and consequently on package 8. Thus, with the band reserve 15, the electromagnetic clutch effective for the main band drive 11 for the second, lower speed exactly operates at the set band tension. In spite of this, band retraction is completed at a maximum speed when the hooping band passes from band channel 2 to the package 8, so that the complete hooping process takes place at maximum speed, but without any dangerous tensions or stresses.

Figure 3:
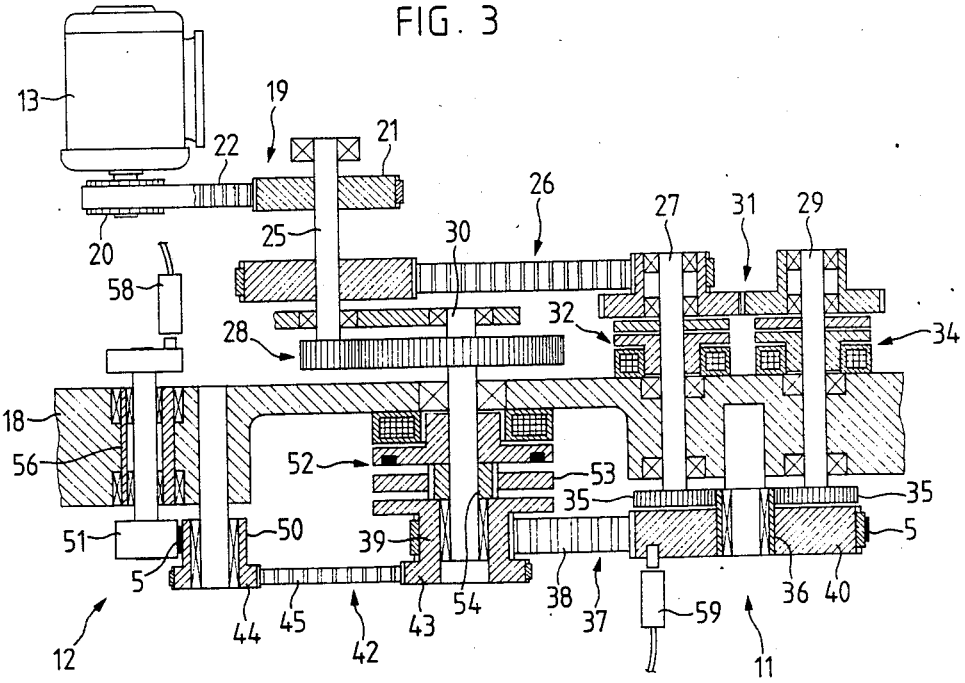
FIG. 3 is a diagrammatic representation of the drive of the machine according to FIGS. 1 and 2.

FIG. 3 diagrammatically shows the band movement drive of the machine of FIGS. 1 and 2. As in FIGS. 1 and 2, the main band drive is 11 and the secondary band drive 12. The two drives 11, 12 and the associated drive parts are mounted in a wall 18 of base 1. In wall 18 is fixed the joining station 10 which, at the end of the hooping process, joins, that is welds the band end to the band and separates the band from the band supply.

By means of an envelope drive 19, comprising two wheels 20, 21 and an envelope member 22, such as a toothed belt, motor 13 drives a distributing shaft 25, which drives by means of a further envelope drive 26 a first clutch shaft 27 and by means of a back gearing 28 a main clutch shaft 30. A second clutch shaft 29 is driven by the first clutch shaft 27 by means of a back gearing 31 with a transmission ratio of 1:1. Each clutch shaft 27, 29 has an electromagnetic clutch 32, 34 enabling said clutch shafts to be coupled to the envelope drive 26. By means of a gear 35, clutch shafts 27, 29 drive a pinion 36 in opposite directions and to which is fixed a roller 40 of a pair of rollers 40, 41 (see FIGS. 1 and 2) of the main band drive 11. Roller 40 is a wheel of an envelope drive 37, whose envelope member 38 drives a wheel 39 on the main clutch shaft 30. Roller 41 is an adjustable, that is eccentric roller enabling the tension of envelope member 38 to be set.

As can be seen from FIGS. 1 and 2, the hooping band 5 is non-positively guided over the roller pair 40, 41, it being pressed on roller 40 on envelope member 38 and on the circumference of roller 41 by envelope member 38. The resulting force closure can transfer a multiple of the maximum tension of hooping band 5.

Wheel 39 of envelope drive 37 is joined to wheel 43 of envelope drive 42, whose further wheel 44 is joined to a roller 50 of a further roller pair 50, 51 of the secondary band drive 12. The non-driven roller 51 of secondary band drive 12 is mounted in rotary manner in an eccentric sleeve 56 in such a way that, during band retraction, the two rollers 50, 51 can form grip rollers for the interposed hooping band 5, but this does not apply during band advance.

A main electromagnetic clutch 52 is mounted on the main clutch shaft 30 and its armature 53 is displaceably mounted on a pinion 54 connected to wheel 39 of envelope drive 37.

The band movement drive according to FIG. 3 functions as follows. In the case of band advance, via envelope drives 19, 26 and one of the two clutch shafts 27, 29, which are correspondingly operated by clutches 32, 34, motor 13 drives the roller pair 40, 41 of the main band drive 11, while the secondary band drive 12 operates somewhat faster. However, as during band advance there is no force closure on secondary band drive 12, there is only a slight insignificant friction through rollers 50, 51 on the advancing band. The hooping band 5 is introduced into the band channel 2 with the first higher speed. As soon as the band end arrives in the joining station 10 (which is sensed by a sensor in the joining station), the main drive 11 is reversed by disengaging one of the clutches 32, 34. Band retraction now takes place with the first higher speed until the hooping band 5 is lightly placed around package 8. During this time, by means of envelope drives 37, 45, the secondary band drive 12 is driven at a somewhat higher speed than that of the roller pair 40, 41, so that the aforementioned band reserve 15 is formed. As soon as the hooping band 5 is placed around the package 8, its speed on the secondary band drive 12 becomes smaller, which is detected by a sensor 58, which now initiates the operation of the main clutch 52 and at the same time the engaged clutch of the two clutches 32, 34 is disengaged. Via back gearing 28, motor 13 now drives wheel 39, so that the roller pair 40, 41 of the main band drive 12 is driven at the second lower speed. The band reserve is now used up by retracting the band and then the hooping band is tensioned around package 8 corresponding to the tensions set on the main clutch 52. A second sensor 59 detects the speed reduction on reaching the set tension and consequently activates the joining station 10, which now ends the hooping process by joining the band end and band and by separating the band supply.

During the retraction of band reserve 5, the band placed around package 8 is free from tension and stationary. The secondary band drive 12 is set in such a way that although revolving during this stationary phase, it exerts no force on the band. When the band reserve 15 has been used up, the band is brought to the tension set on main clutch 52 and joining station 10 is activated.

Thus, the switching over of main clutch 52 and clutches 32, 34 takes place in a stationary phase, where the band is not additionally stressed. Even though the time interval for operating clutches 32, 34, 52 is very short, at the first higher speed used of approximately 5 m/s, the band travel is about 0.5 m. If there were no band reserve 15, additional band stressing could occur in the switching time and would lead to the known disadvantages.

FIG. 3 does not specifically show the bearings for mounting the rotating parts, but they are represented by rectangles having diagonals. Clutches 32, 34 are also only illustrated to the extent necessary. These are in fact normal commercial electromagnetic clutches, the main clutch 52 being additionally improved in the manner described in the aforementioned patent application.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A process for hooping a package with a hooping band comprises: providing a first and second band supply means and a joining station, feeding a band from said first band supply means to said joining station such that said band envelopes a package to the hooped, sensing when said band arrives at said joining station, retracting said band by said first band supply means at a first speed and said second band supply means at a second speed upon sensing the arrival between said first and second band supply means of said band at said joining station so as to create a reserve band loop while loosely engaging said band around said package, sensing when said band is loosely engaged, further retracting said band by said first band supply means at a second speed lower than said first speed so as to use up said reserve band loop while tensioning said band around said package, sensing when said band is tensioned, joining said band in said joining station and separating the joined band from said joining station.

2. A process according to claim 1 including temporarily interrupting the feeding of the band from said band supply means during the retraction of said band at said first speed so as to create a band reserve.

3. A machine for hooping a package with a hooping band comprising band supply means and a joining station, said band supply means including main band drive means for feeding said band from said band supply means to said joining station, first sensing means associated with said joining station for sensing when said band arrives at said joining station, reversing means for reversing said main band drive means for retracting said band at a first speed upon the sensing of arrival of said band at said joining station by said first sensing means so as to loosely engage said band around the package, second sensing means for sensing when said band is loosely engaged around the package, speed control means associated with said main band drive means for retracting said band at a second speed lower than said first speed upon the sensing by said second sensing means so as to tension said band around the package, third sensing means for sensing when said band is tensioned around the package and means in said joining station for joining said band and further including a secondary band drive means for retracting said band at a third speed higher than said first speed for creating a band reserve.

4. A machine according to claim 3 wherein the secondary band drive has a roller pair for retracting said band.

5. A machine according to claim 4 wherein one roller of the roller pair can be driven and the other roller is constructed as an eccentrically positioned grip roller.

6. A machine according to claim 4 wherein one roller of the pair is driven by means of the main band drive.

7. A machine according to claim 3 wherein two electromagnetic clutches are provided in the band supply means for the band feeding and the band retraction at the first speed and a third electromagnetic clutch associated with said third sensing means for presetting the tension of the hooping band is provided for the band retraction at the second speed for tensioning the hooping band.

8. A machine according to claim 4 wherein said main band drive and said secondary band drive are provided with a collecting magazine for said band reserve formed during band retraction at said first speed, said magazine is provided with a level indicator.

* * * * *

UNITED STATES PATENT AND TRADEMARK OFFICE

CERTIFICATE OF CORRECTION

PATENT NO. : 4,691,498

DATED : September 8, 1987

INVENTOR(S) : Nikolaus Stamm

It is certified that error appears in the above-identified patent and that said Letters Patent is hereby corrected as shown below:

Column 5, claim 1, line 27, delete "the" and insert --be--.

Signed and Sealed this

Nineteenth Day of January, 1988

*Attest:*

*Attesting Officer*

DONALD J. QUIGG

*Commissioner of Patents and Trademarks*